US007264321B1

(12) United States Patent
Bueley et al.

(10) Patent No.: US 7,264,321 B1
(45) Date of Patent: Sep. 4, 2007

(54) DOOR MOUNTING SYSTEM FOR A STORAGE UNIT

(75) Inventors: Douglas J. Bueley, Petawawa (CA); William H. Punzel, Fort Atkinson, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 09/700,890

(22) PCT Filed: Feb. 29, 2000

(86) PCT No.: PCT/US00/05209

§ 371 (c)(1),
(2), (4) Date: Sep. 25, 2001

(87) PCT Pub. No.: WO01/64075

PCT Pub. Date: Sep. 7, 2001

(51) Int. Cl.
*A47B 47/00* (2006.01)

(52) U.S. Cl. ..... 312/265.5; 312/257.1

(58) Field of Classification Search ..... None
See application file for complete search history.

(56) References Cited

U.S. PATENT DOCUMENTS 464,201 A 12/1891 Rowland
1,368,604 A * 2/1921 Carmody ..... 411/162
3,905,712 A 9/1975 McConnell
5,464,281 A 11/1995 Maro
5,570,940 A 11/1996 Maro
6,238,027 B1 * 5/2001 Kohler et al. ..... 312/265.1

* cited by examiner

*Primary Examiner*—John G. Weiss
*Assistant Examiner*—Michael Fisher
(74) *Attorney, Agent, or Firm*—Boyle Fredrickson, SC

(57) ABSTRACT

A system for mounting doors to a cabinet assembly which includes posts at the corners of the cabinet assembly. Each corner post defines an inner wall having spaced openings. A pair of door mounting assemblies are engageable with each corner post. Each door mounting assembly includes a hinge assembly and a mounting bracket which is engageable with a pair of openings in the inner wall of the corner post. The hinge assembly includes a first section mounted to the door and a second section mounted to the mounting bracket. The hinge sections are removably engageable with each other, such that the mounting bracket and second hinge section are separately engageable with the post. The mounting bracket includes a pair of engagement members which are received within a pair of openings in the post, to secure the mounting bracket and second section of the hinge to the post. The mounting bracket also includes a locking member for engagement with an opening in the post for releasably locking the mounting bracket in position. The door is mounted to the cabinet assembly by engaging the first hinge sections, which are mounted to the door, with the second hinge sections after engagement of the second hinge sections with the posts via the mounting brackets. Retainer brackets are engageable with top and bottom cross-members of the cabinet assembly, separate from the door mounting arrangement, for interacting with a locking or latching mechanism provided on the door to selectively maintain the door in a closed position.

31 Claims, 9 Drawing Sheets

FIG. 7
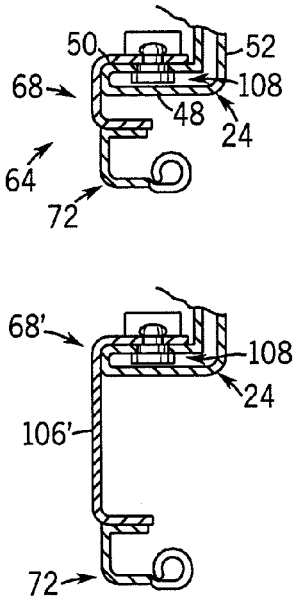
FIG. 13
FIG. 9
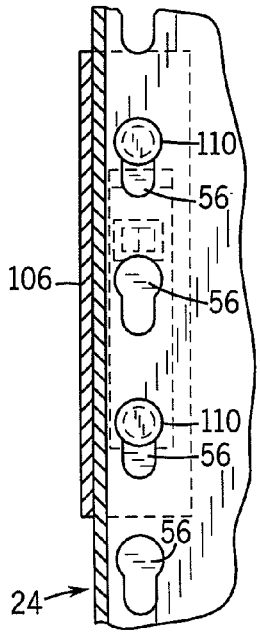
FIG. 12
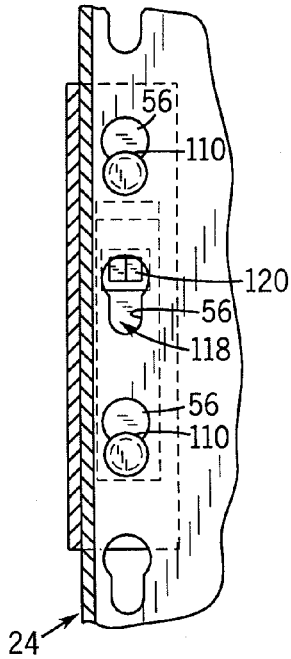
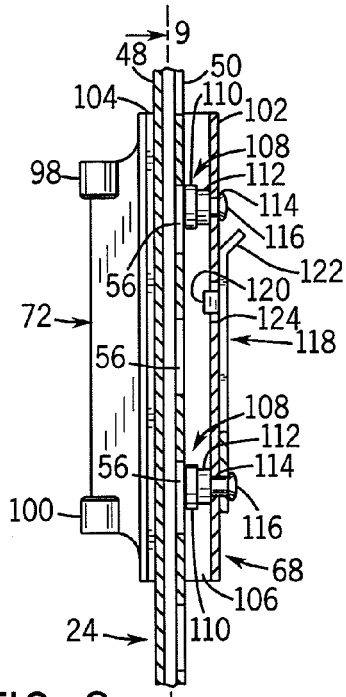
FIG. 8 → 9
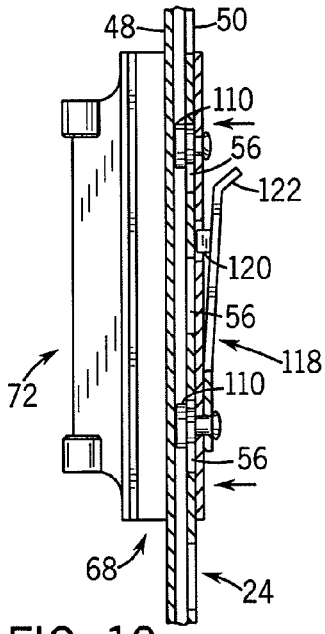
FIG. 10
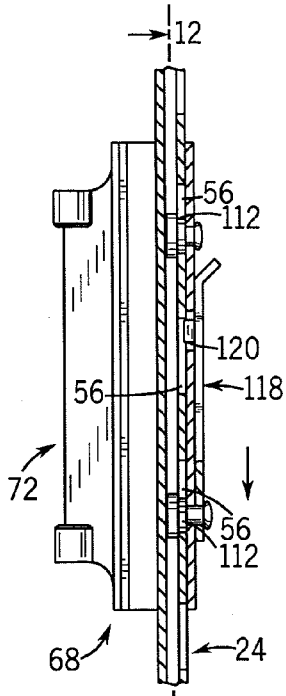
FIG. 11 → 12

FIG. 14
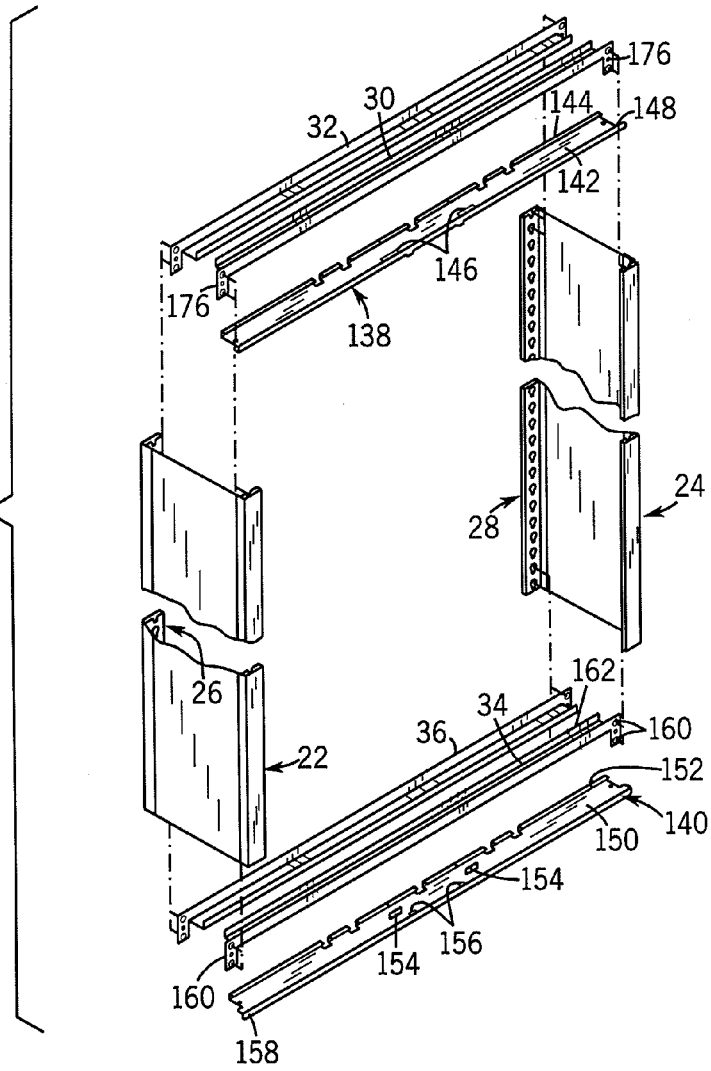
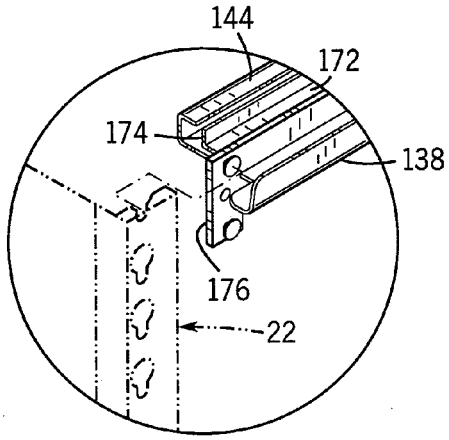
FIG. 15
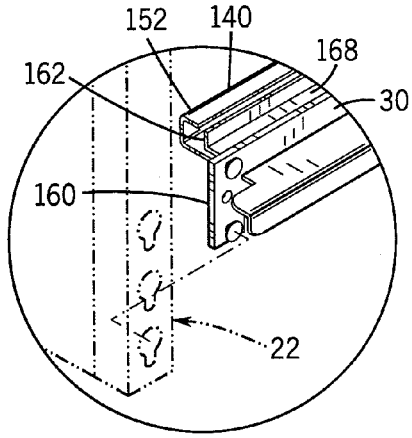
FIG. 16

FIG. 17
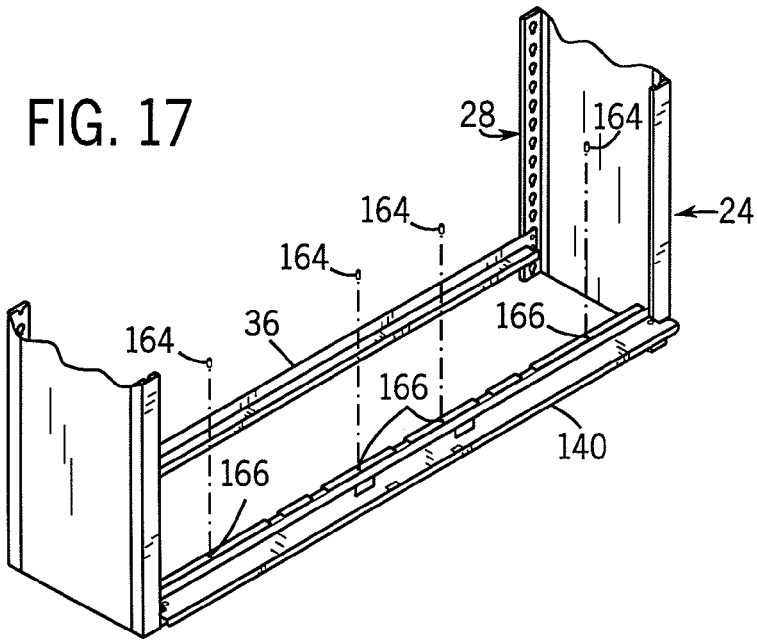
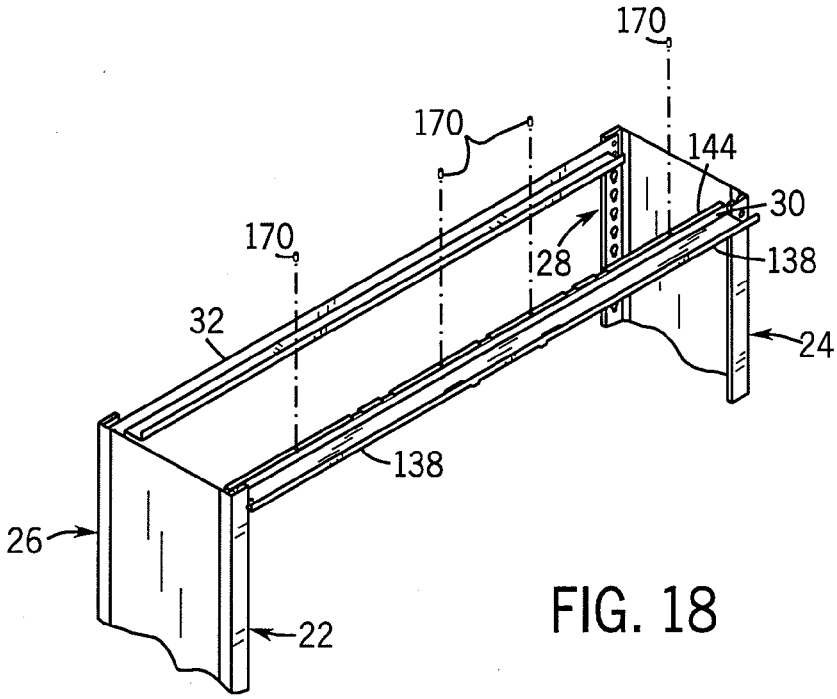
FIG. 18

DOOR MOUNTING SYSTEM FOR A STORAGE UNIT

BACKGROUND AND SUMMARY OF THE INVENTION

This invention relates to a system for mounting one or more doors to a storage unit such as a cabinet or shelf assembly.

A metal storage unit, such as a conventional cabinet or shelf assembly, typically includes a rectangular frame structure having a pair of front corner posts and a pair of rear corner posts. Each corner post is typically formed with a surface having vertical rows of equally spaced, attachment openings for attaching shelves at various elevations. The posts are also adapted to support shelving accessories, such as drawers or flipper doors. A drawer or flipper door is typically secured by a slide mechanism or other support structure interconnected with the corner posts of the cabinet using the attachment openings. An example of a mounting arrangement of this type is disclosed in co-pending application Ser. No. 09/434,969 filed Nov. 5, 1999, the disclosure of which is hereby incorporated by reference.

It is also desirable to mount one or more doors to a cabinet assembly of this type. Examples of door mounting systems are disclosed in Maro U.S. Pat. Nos. 5,464,281 and 5,570,940. The door mounting system disclosed in these patents involves mounting of top and bottom support members, each of which spans between and engages the uprights or posts of the cabinet assembly. The top and bottom support members define hinge openings, each of which is adapted to receive a bushing. A specially constructed hinge pin assembly is mounted to the top of the door and to the bottom of the door. The hinge pin assembly includes an outwardly biased hinge pin, which can be manually retracted to locate the door between the upper and lower support members. Engagement of the hinge pins is then released, and the hinge pins then extend outwardly into the bushings so as to pivotably mount the door to the cabinet assembly.

It is an object of the present invention to provide a door mounting system which utilizes a conventional hinge assembly for providing movement of the door relative to the cabinet assembly. It is a further object of the invention to provide a door mounting system in which the door can be mounted to the cabinet assembly without the use of tools. Another object of the invention is to provide a door mounting system which is simple in its components and the manner in which the door mounting components are mounted to the cabinet assembly and engaged with the door. Yet another object of the invention is to provide a door mounting system which provides consistent positioning of the door relative to the cabinet assembly. A still further object of the invention is to provide a door mounting system in which the door is mounted to the cabinet assembly independent of the latching structure which interacts with the door latch for maintaining the door in its closed position.

The invention contemplates a door mounting system for a cabinet assembly or storage unit having an open area providing access to an interior defined by the storage unit. The storage unit includes at least one structural member adjacent the open area, and the structural member includes a series of spaced openings. The invention contemplates a door and a hinge assembly having pivotable first and second sections. The first section of the hinge is adapted for mounting to the door, and the second section of the hinge is secured to a mounting member. The mounting member is engageable with the structural member of the storage unit, and interacts with at least a pair of the spaced openings in the structural member for fixing the position of the second section of the hinge relative to the structural member of the storage unit. The openings in the structural member are formed in an inner wall defined by the structural member and face toward the interior of the storage unit. The mounting member includes an inner portion having engagement structure which interacts with the pair of spaced openings, and an outer portion to which the second section of the hinge is mounted. The engagement structure is preferably in the form of a pair of engagement members, each of which is adapted to be engaged within one of the openings in the structural member.

A releasable locking member is interconnected with the mounting member, and is releasably engageable with the structural member for releasably maintaining the pair of engagement members within the pair of openings in the structural member. In a preferred form, the releasable locking member is movable between a locking position in which the locking member is engaged within one of the openings in the structural member, and a release position in which the locking member is removed from the opening in the structural member. In its locking position, the locking member engages an edge of the opening and prevents movement of the mounting member relative to the structural member, so as to maintain the second section of the hinge in position on the structural member. In its release position, the locking member is moved out of engagement with the edge of the opening and allows movement of the mounting member relative to the structural member, so as to enable the pair of engagement members to be disengaged from the pair of openings. The locking member is preferably biased toward its locking position, and is engaged within one of the openings when the pair of engagement members are seated within the pair of spaced openings. In a preferred form, the locking member is mounted to a spring member which provides snap-in engagement of the locking member with the opening when the engagement members are seated within the pair of openings.

The first and second sections of the hinge are preferably releasably engageable with each other. With this construction, the mounting member is first engaged with the structural member, so as to mount the second section of the hinge in position on the storage unit. Once the second section of the hinge is mounted in this manner, the door is mounted in position relative to the storage unit by engaging the first section of the hinge with the second section.

The door preferably includes a latch or lock arrangement at a location spaced from the hinge. A retainer or latch member is engageable with the storage unit separately from the mounting member, and the latch or lock arrangement is engageable with the retainer member for selectively maintaining the door in a closed position relative to the storage unit. The storage unit preferably includes upper and lower transverse members which extend between a pair of structural members which extend vertically and are located one on either side of the open area of the storage unit. A retainer member is engageable with each of the upper and lower transverse members, so as to engage upper and lower latch members of the latch or lock arrangement. Each retainer member includes a mounting arrangement which takes advantage of the existing structure of the upper and lower transverse members of the storage unit, for providing quick and easy mounting of the retainer members to the upper and lower transverse members.

The invention further contemplates a method of mounting a door to a storage unit, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 7 is a partial transverse section view taken along line 7-7 of FIG. 5;

FIG. 8 is a partial longitudinal section view showing the mounting member and structural member of FIG. 6 prior to movement of the engagement members of the mounting member into openings in the structural member;

FIG. 9 is a partial section view taken along line 9-9 of FIG. 8;

FIG. 10 is a view similar to FIG. 8, showing movement of the engagement members of the mounting member into the openings in the structural member;

FIG. 11 is a view similar to FIGS. 8 and 10, showing the engagement members seated within the openings;

FIG. 12 is a section view taken along line 12-12 of FIG. 11;

FIG. 13 is a view similar to FIG. 7, showing an alternate embodiment of the mounting member of the present invention for extended mounting of the doors;

FIG. 14 is an exploded isometric view illustrating certain of the components of the storage unit of FIGS. 1-3 and top and bottom latching brackets adapted for mounting to the storage unit and forming a part of the door mounting arrangement of the present invention;

FIG. 15 is a partial isometric view illustrating mounting of a top one of the latching brackets of FIG. 14;

FIG. 16 is a partial isometric view illustrating mounting of a bottom one of the latching brackets of FIG. 14;

FIG. 17 is a partial isometric view illustrating installation of the bottom latching bracket of FIGS. 14 and 16;

FIG. 18 is a partial isometric view illustrating installation of the top latching bracket of FIGS. 14 and 15;

DETAILED DESCRIPTION OF THE INVENTION

Figure 1:
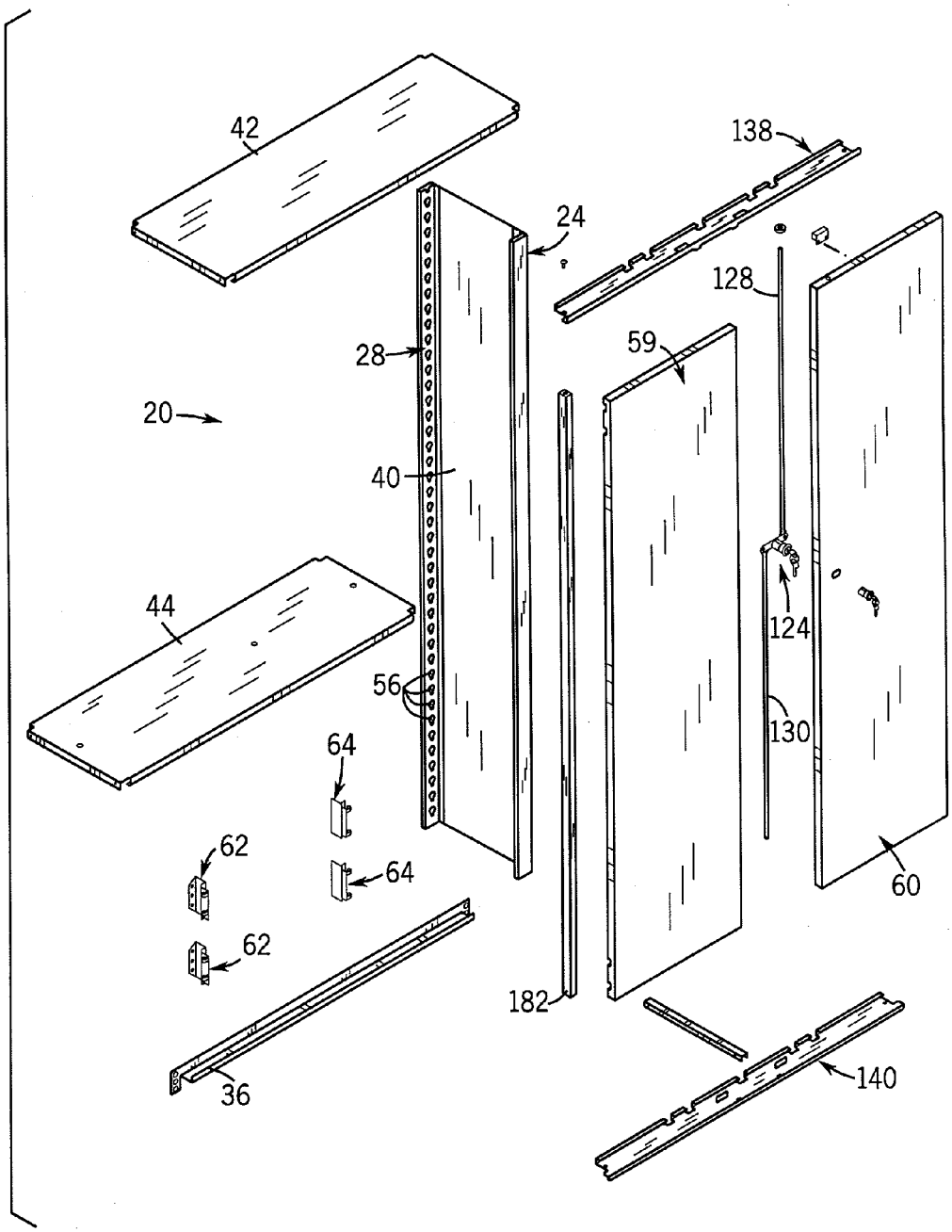
FIG. 1 is an exploded isometric view showing the components of a storage unit and the door mounting arrangement of the present invention.
Figure 2:
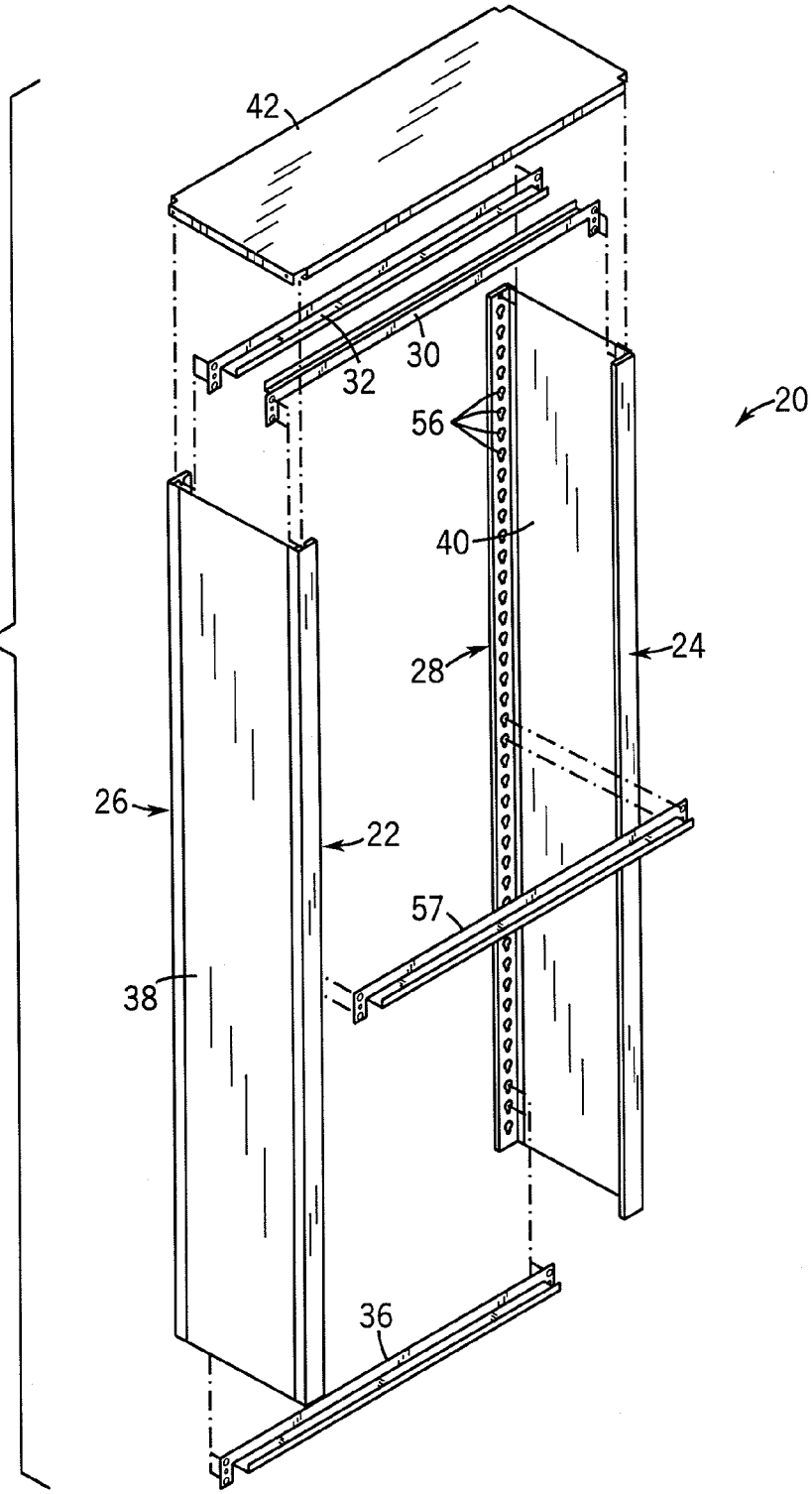
FIG. 2 is an exploded isometric view illustrating construction of the storage unit of FIG. 1.
Figure 3:
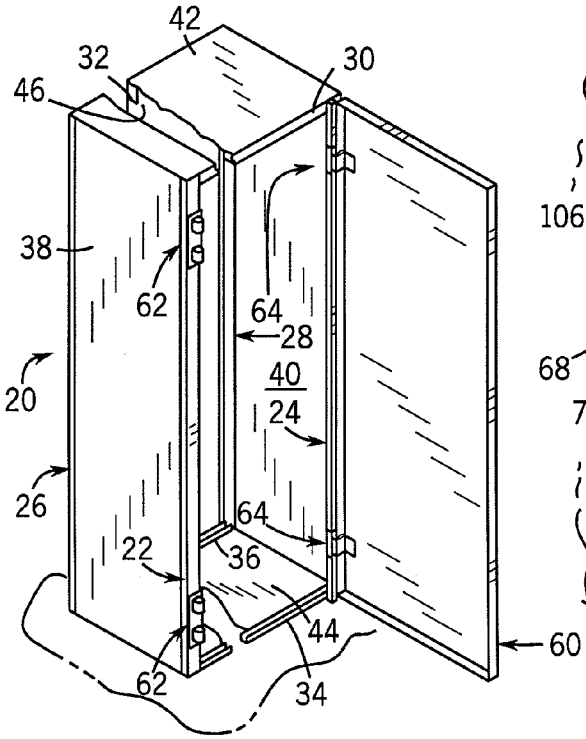
FIG. 3 is an isometric view of the storage unit of FIGS. 1 and 2 showing one of a pair of doors mounted to the storage unit utilizing the hinged door mounting arrangement of the present invention.

Referring to FIGS. 1-3, a cabinet assembly 20 is formed of a frame including a pair of front posts 22, 24, a pair of rear posts 26, 28, a pair of top cross-members 30, 32 and a pair of bottom cross-members 34, 36. Cabinet assembly 20 further includes a side wall 38 which extends between and is interconnected with front post 22 and rear post 26, and a side wall 40 which extends between and is interconnected with front post 24 and rear post 28. Cabinet assembly 20 may also include a top wall 42, a bottom wall 44 and a rear wall 46. Cabinet assembly 20 defines an interior and a front opening defined by front posts 22, 24 and top and bottom cross-members 30, 34, respectively, which provides access to the interior of cabinet assembly 20. The overall construction of cabinet assembly 20 is conventional and known in the art.

Figure 4:
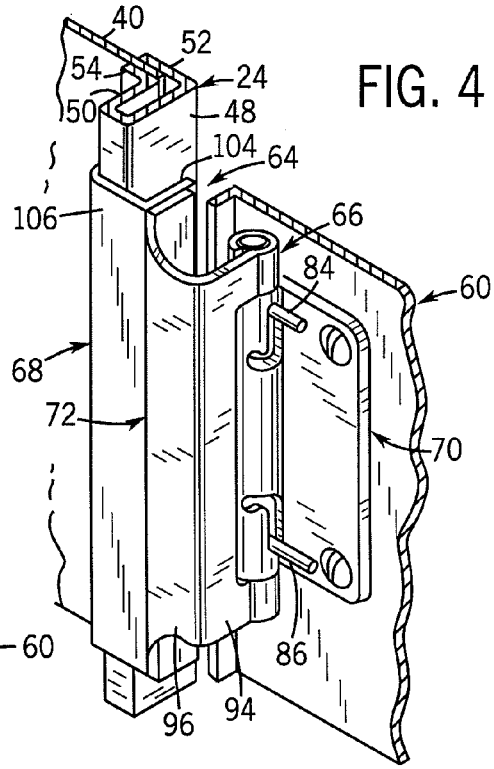
FIG. 4 is a partial isometric view showing a portion of the storage unit of FIGS. 1-3 and the hinged door mounting system of the present invention.
Figure 5:
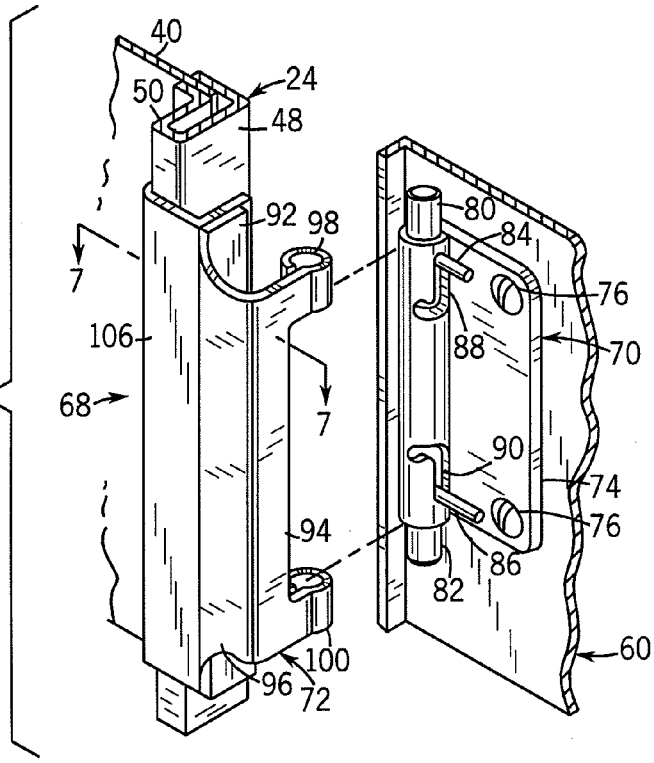
FIG. 5 is a view similar to FIG. 4, showing disengagement of the hinge sections and the door removed from the storage unit.
Figure 6:
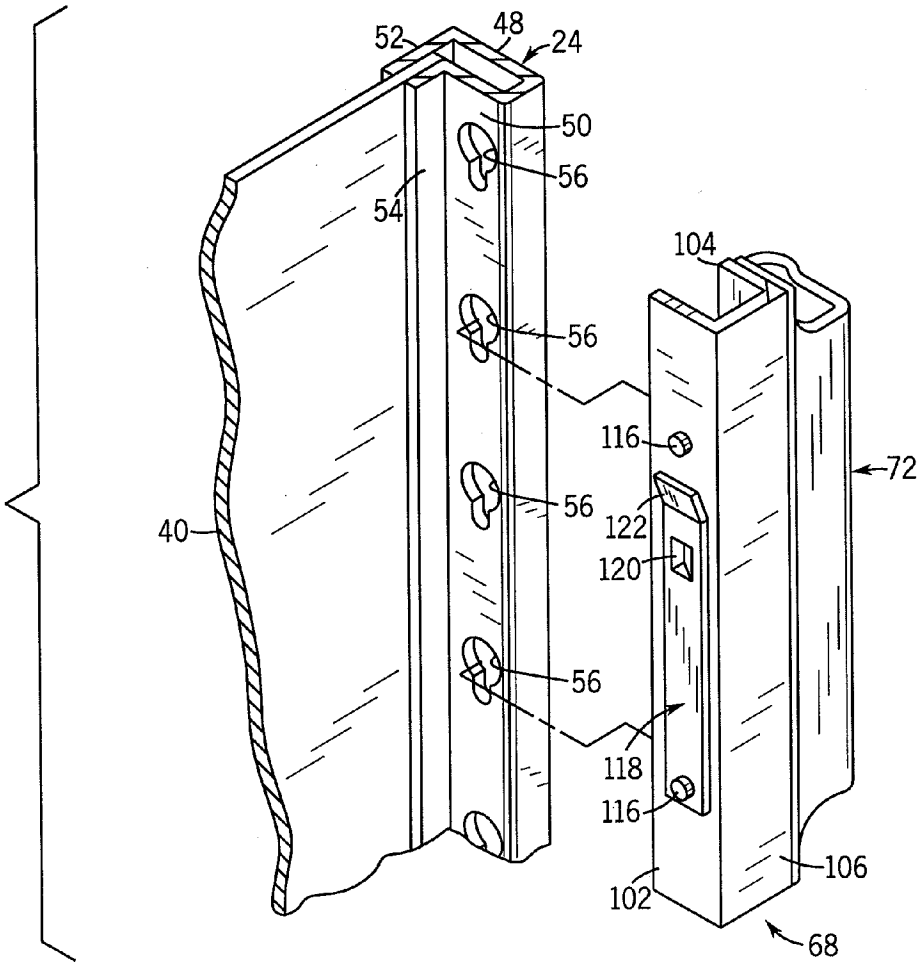
FIG. 6 is an isometric view illustrating the mounting member incorporated into the door mounting arrangement of FIGS. 3-6 disengaged from the structural member of the storage unit.
Figure 19:
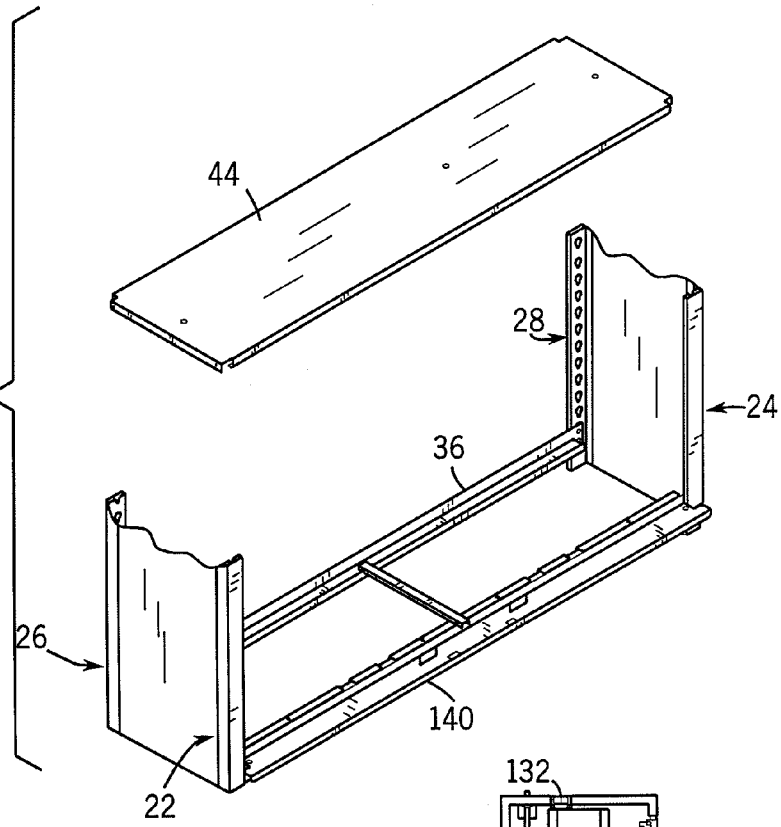
FIG. 19 is a partial isometric view showing a bottom shelf for mounting over the installed bottom latching bracket of FIGS. 14, 16 and 17.

Front posts 22 and 24 are mirror images of each other, as are rear posts 26, 28. With reference to FIGS. 4-6, and in accordance with conventional construction, front post 24 includes an outer wall 24, an inner wall 50 which is parallel to outer wall 48, and side walls 52, 54 which extend from the ends of outer and inner walls 48, 50, respectively. Side wall 40 of cabinet assembly 20 is secured at its front edge between side walls 52 and 54, in a conventional manner. A similar construction is provided for posts 22, 26 and 28 and connection of side walls 38 and 40.

Referring to FIG. 6, post 24 includes a series of equally spaced keyhole-shaped openings 56 formed in inner wall 50 throughout the length of post 24, again in a manner as is known. Similar openings 56 are formed in front post 22 as well as rear posts 26, 28. Openings 56 are adapted to mount shelf support brackets such as 57 (FIG. 2) having the same construction as cross-members 30 and 32, for mounting shelves to posts 22-28 within the interior of cabinet assembly 20, in a manner as is known. Each opening 56 defines an upper enlarged portion adapted to receive the head of a rivet or the like protruding from the shelf support bracket, and a lower slotted portion within which the shank of the rivet is received when the shelf support bracket is moved downwardly, so as to securely engage the shelf support brackets with the posts. The shelf support brackets can be located at varying elevations so as to provide shelving at various elevations within the interior of cabinet assembly 20.

In accordance with the present invention, a pair of doors 59, 60 are adapted for mounting to cabinet assembly 20 for selectively enclosing the open front area of cabinet assembly 20 to selectively enclose the interior of cabinet assembly 20. Door 60 is adapted for mounting to front post 24, and door 59 is adapted for mounting to front post 22. A pair of door mounting assemblies 62 are engaged with front post 22 for mounting door 59 thereto, and a pair of mirror image door mounting assemblies 64 are engaged with front post 24 for mounting door 60 thereto. Mounting assemblies 62 and 64 are mirror images of each other, and the following description of each door mounting assembly 64 and its engagement with post 24 applies equally to each door mounting assembly 62 and its engagement with post 22.

Referring to FIGS. 4-6, door mounting assembly 64 includes a hinge assembly 66 and a mounting member 68. Hinge assembly 66 is a concealed lift-off type hinge assembly, such as is available from Southco, Inc. of Concordville, Pa. under its Part Nos. F6-1, F6-2 and F6-3. Hinge assembly 66 includes a first section in the form of a door leaf 70, and a second section in the form of a frame leaf 72.

Door leaf 70 includes a flat plate section 74 which engages the inside surface of door 60 and is mounted thereto by threaded fasteners 76, such as screws, which extend through aligned openings in door 60 and plate section 74. A barrel 78 is formed at the outer end of plate section 74, and upper and lower hinge pins 80, 82, respectively, extend from the ends of barrel 78. Roll pins 84 and 86 are mounted to hinge pins 80 and 82, respectively, and extend through hooked slots 88 and 90, respectively, formed in barrel 78. A spring arrangement (not shown) is located within barrel 78 for hinge biasing pins 80 and 82 outwardly beyond the ends of barrel 78, as shown in FIG. 5.

In a manner as is known, hinge pins 80 and 82 can be retracted into barrel 78 by movement of roll pins 84 and 86, respectively, within slots 88 and 90, respectively. Movement of roll pins 84 and 86 into the hooked ends of slots 88, 90, respectively, functions to maintain hinge pins 80 and 82 in a retracted position, in which the pin end is located slightly inwardly of the end of barrel 78. When roll pins 84 and 86 are moved out of the hooked end portions of slots 88 and 90, respectively, the biasing force of the spring arrangement functions to urge hinge pins 80 and 82 outwardly beyond the ends of barrel 78.

Frame leaf 72 of hinge assembly 66 includes a flat mounting section 92, an outer section 94 and a connecting section 96 which extends between mounting section 92 and outer section 94. A pair of tubular ears or receivers 98, 100 are formed at the top and bottom ends, respectively, of outer section 94, and define aligned passages. Barrel 78 is adapted to be positioned between receivers 98 and 100 with pins 80 and 82 retracted. Movement of pins 80 and 82 to their extended positions locates pins 80 and 82 within the passages defined by receivers 98 and 100, respectively, to pivotably engage door leaf 70 with frame leaf 72, in a manner as is known.

Mounting member 68 of door mounting assembly 62 is a C-shaped member, defining an inner wall 102, an outer wall 104 spaced from and extending parallel to inner wall 102, and an intermediate wall 106 extending between and interconnecting inner wall 102 and outer wall 104. Mounting section 92 of frame leaf 72 is secured to outer wall 104 in any satisfactory manner, such as by welding. Together, mounting member 68 and frame leaf 72 of hinge assembly 66 make up a subassembly through which door 60 is mounted to cabinet assembly 20 by engagement of door leaf 70 with frame leaf 72.

Referring to FIGS. 7 and 8, a pair of engagement members 108 are mounted to inner wall 102 of mounting member 68. Each engagement member 108 includes a head 110 and a shoulder 112 which are located in the space between inner wall 102 and outer wall 104. A neck 114 is received within an opening formed in inner wall 102, and an enlarged end 116 is formed at the end of neck 114 opposite shoulder 112. Engagement members 108 may be in the form of conventional rivets which are secured to inner wall 102 in a conventional manner. Engagement members 108 are spaced apart a distance corresponding to the spacing between the top and bottom openings in a set of three openings 56 formed in post 24. That is, head 110 of each engagement member 108 is adapted to be received within the enlarged upper portion of one of openings 56, with an opening 56 being located between the two openings 56 within which engagement members 108 are received. Head 110 of each engagement member 108 is sized so as to pass through the enlarged upper portion of opening 56, and shoulder 112 is adapted to be received within the slotted lower portion of opening 56 upon downward movement of mounting member 68 relative to post 24. When shoulder 112 is received within the slotted lower portion of an opening 56, head 110 engages the inner surface of post inner wall 50 on either side of the slotted lower portion of opening 56, so as to retain mounting member 68 in position on post 24.

A locking spring 118 is mounted to inner wall 102 of mounting member 68. Locking spring 118 is in the form of an elongated, flat leaf-type spring, having an opening in its lower end through which neck 114 of the lower one of engagement members 108 extends. Locking spring 118 is further provided with a locking member in the form of a projection 120, and an angled upper end 122. An aperture 124 is formed in mounting member inner wall 102, and locking projection 120 is located in alignment with aperture 124. Locking member 120 has a length which extends beyond the outer surface of inner wall 102. The biasing force of locking spring 118 functions to urge locking member 120 toward a locking position, in which locking projection 120 extends through aperture 124 to its FIG. 8 position, extending past the outer surface of inner wall 102.

In operation, a pair of door mounting assemblies 64 function as follows to mount door 60 to cabinet assembly 20.

For each door mounting assembly 64, door leaf 70 of hinge assembly 66 is first mounted to door 60 toward the outer edge of door 60. As noted previously, fasteners 76, such as screws, extend through aligned openings in door leaf 70 and door 60 for securing door leaf 70 to door 60, although it is understood that any other satisfactory mounting arrangement may be employed, such as riveting, welding, etc. Frame leaf 72 of each hinge assembly 66 is then mounted to outer wall 104 of mounting member 68, such as by welding or in any other satisfactory manner.

When it is desired to mount door 60 to cabinet assembly 20, the user engages a pair of mounting members 68 with front post 24 in locations on front post 24 which correspond to the spacing between frame leafs 70 as mounted to door 60. To do this, the user selects the appropriate ones of openings 56 in front post 24 which are to be employed to secure mounting member 68 in position. The user then places mounting member 68 such that the inwardly extending walls of post 24, i.e. outer wall 24 and inner wall 50, are received within the space between inner wall 102 and outer wall 104 of mounting member 68, as shown in FIGS. 8 and 9. Engagement member heads 108 are located in alignment with the enlarged upper ends of openings 56, and mounting member 68 is then moved outwardly to the position as illustrated in FIG. 10, wherein head 110 of each engagement member 108 passes through the enlarged upper portion of opening 56. A downward force is then applied to mounting member 68, which results in movement of shoulder 112 of each engagement member 108 into the slotted lower portion of opening 56, as shown in FIGS. 11 and 12. Mounting member 68 is moved downwardly relative to post 24 such that shoulder 112 firmly seats against the lower end of the slotted lower portion of opening 56. Head 110 of each engagement member 108 engages post inner wall 50 adjacent the edges of the slotted lower portion of opening 56, so as to maintain engagement member 68 in position on post 24.

As mounting member 68 is moved inwardly from its FIG. 8 position to its FIG. 10 position, locking projection 120 engages post inner wall 50 between the openings 56 within which engagement members 108 are received, and above the opening 56 therebetween. This functions to move locking spring 118 outwardly against the biasing force of locking spring 118, as shown in FIG. 10. As mounting member 68 is moved downwardly to its FIG. 11 position, locking projection 120 moves outwardly under the influence of locking spring 118 into the upper extent of the opening 56 between the openings 56 within which engagement members 108 are received, as shown in FIGS. 11 and 12. Locking projection 120 is positioned such that, when engagement member shoulders 112 are seated against the lower end of the slotted lower portion of openings 56, locking projection 120 moves into the enlarged upper area of the opening 56 therebetween, under the influence of locking spring 118. With locking projection 120 positioned in this manner, engagement of the upper edge of locking projection 20 with the upper edge of the opening 56 within which locking projection 20 is received, prevents upward movement of engagement member 68 relative to post 24. Mounting member 68 is thus locked in position on post 24. When it is desired to remove mounting member 68 from post 24, the user manually engages upper end 122 of locking spring 118, and flexes locking spring 118 away from inner wall 102 to withdraw locking projection 120 from opening 56. An upward force is then applied to mounting member 68, so as to move mounting member 68 from its FIG. 11 position to its FIG. 10 position, in which engagement member heads 110 are aligned with the enlarged upper portions of openings 56. An inward force is then applied to mounting member 68 to pass engagement member heads 110 through openings 56 and to thereby disengage mounting member 68 from post 24.

With the pair of engagement members 68 mounted to post 24 in the manner described above, door 60 is then secured in position by retracting hinge pins 80, 82, placing barrel 78 between receivers 98, 100, and extending hinge pins 80, 82 so as to position hinge pins 80, 82 within the passages defined by receivers 98, 100, respectively. In this manner, door 60 is pivotably mounted to post 24 for movement between an open position as shown in FIG. 3, and a closed position in which door 60 closes the opening of cabinet assembly 20 which provides access to the interior of cabinet assembly 20.

As noted, door 59 is engaged with a pair of mounting assemblies 62 which are secured to post 22 in an identical manner to that described with respect to door 60 and mounting assemblies 64. With doors 59, 60 mounted to posts 22, 24, respectively, in this manner, doors 59, 60 cooperate to fully close cabinet assembly 20 when in the closed position.

FIG. 13 illustrates a slightly modified mounting member 68' which is adapted for mounting to post 24. In this modified version, mounting member 68' has an extended intermediate wall 106', which positions frame leaf 72 in an outwardly extended position relative to post 24. This functions to locate door 60 outwardly relative to cabinet assembly 20, to provide additional clearance between door 60 and the shelves mounted within cabinet assembly 20.

Figure 20:
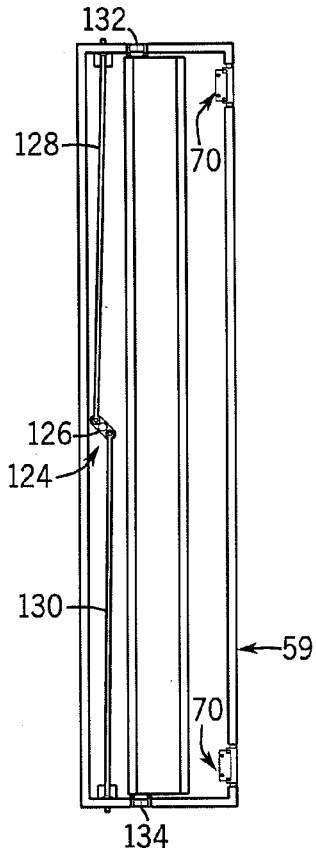
FIG. 20 is a rear plan view of a door incorporated into the door mounting arrangement of FIGS. 1-3.

In a manner as is known, one or the other of doors 59, 60 includes a latching or locking mechanism for maintaining the door in its closed position. Referring to FIG. 20, door 59 includes a latch mechanism 124 which includes a manually operable actuator 126 and a pair of lock or latch members 128, 130 which are mounted to actuator 126 and to door 59. Upper latch member 128 extends from actuator 126 upwardly to the upper edge of door 59, and lower latch member 130 extends from actuator 126 downwardly to the lower edge of door 59. Rotation of actuator 126 results in movement of latch members 128, 130 to an extended position, in which the upper end of upper latch member 128 projects past the upper edge of door 59 and the lower end of lower latch member 130 extends past the lower edge of door 59. Door 60 may also include a latch mechanism such as 124 for selectively maintaining door 60 in a closed position. Alternatively, door 60 may include a vertical flange which engages the side edge of door 59 when doors 59 and 60 are closed, such that latching door 59 maintains both door 59 and door 60 in the closed position.

As shown in FIG. 20, door 59 includes a pair of magnet assemblies 132, one of which is located at the top edge of door 59 and the other of which is located at the bottom edge of door 59. Door 60 includes a pair of similarly located magnet assemblies.

FIG. 14 illustrates a top latch/stop bracket 138 which is adapted for mounting to top cross-member 30, and a bottom latch/stop bracket 140 which is adapted for mounting to bottom cross-member 34. Latch/stop brackets 138, 140 are adapted for engagement with cabinet assembly 20 independent of door mounting assemblies 62 and 64, and interact with the components of doors 59, 60 for selectively maintaining doors 59, 60 in the closed position.

Referring to FIGS. 14 and 15, upper latch/stop bracket 138 defines a horizontal wall 142 and a mounting channel 144 formed at the rear edge of horizontal wall 142. A pair of stops 146 are mounted to horizontal wall 142. Each stop 146 is in the form of an inverted L-shaped member, having a horizontal leg secured to the upper surface of horizontal wall 142, and a vertical leg which extends through a slot in horizontal wall 142 and extends downwardly from the lower surface of horizontal wall 142. A pair of oval openings are formed in horizontal wall 142 adjacent its front edge, and a flange 148 extends vertically upwardly from the front edge of horizontal wall 142.

Latch/stop bracket 140 has a construction similar to that of latch/stop bracket 138, including a horizontal wall 150, a mounting channel 152 and a pair of stops 154, which are mounted to horizontal wall 150 such that the horizontal leg of each stop 154 is secured to the lower surface of horizontal wall 150 and the vertical leg of stop 154 extends upwardly through a slot formed in horizontal wall 150. A pair of oval openings 156 are formed in horizontal wall 150 adjacent the front edge of horizontal wall 150, and a flange 158 extends downwardly from the front edge of horizontal wall 150.

Referring to FIGS. 14, 16 and 17, latch/stop bracket 140 is mounted to cabinet assembly 20 by positioning horizontal wall 150 of latch/stop bracket 140 between the depending ends, shown at 160, of shelf support bracket 34. An upstanding flange, shown at 162, of shelf support bracket 34 is then moved into mounting channel 152. A series of set screws 164 are then engaged within threaded openings 166 formed in the top wall of mounting channel 152, and are driven into engagement with an inwardly extending surface 168 defined by shelf support bracket 34. Openings 166 and set screws 164 are sized and located such that the vertical flange 162 of shelf support bracket 34 engages the vertical inner wall of mounting channel 152, and set screws 164 thus function to rigidly interconnect shelf support bracket 34 with latch/stop bracket 140. With latch/stop bracket 140 assembled to shelf support bracket 34 in this manner, shelf support bracket 34 is engaged with cabinet posts 22, 24 in a conventional manner, using rivets provided on dependent legs 160 of shelf support bracket 34.

Referring to FIGS. 14, 15 and 18, latch/stop bracket 138 is mounted to upper cross-member 30 in a similar manner. Upper cross-member 30 has a construction identical to shelf support bracket 34. A series of set screws 170 extend through threaded openings in the top wall of mounting channel 144, into engagement with a surface 172 of upper cross-member 30 when vertical flange 174 of upper cross-member 30 is received within mounting channel 144. Upper cross-member 30 is then engaged with posts 22, 24 utilizing rivets mounted to depending legs 176 located at the ends of upper cross-member 30, in a conventional manner.

With latch/stop brackets 138, 140 and doors 59, 60 mounted to cabinet assembly 20 in this manner, magnet assemblies 132 and 134 of door 59 engage the leftward ones of stops 146, 154 when door 59 is closed, to maintain door 59 in its closed position. Similar magnet assemblies are mounted to door 60 for engaging the rightward ones of stops 146, 154, to maintain door 60 closed when door 60 is in its closed position. Typically, a handle (not shown) is provided on one of doors 59, 60 for use in moving doors 59, 60 between the open and closed positions.

When it is desired to lock or latch a door in its closed position, such as door 59, latch actuator 126 is rotated so as to extend latch members 128, 130 when door 59 is closed. Latch actuator 126 may be manually movable in response to rotation of a handle, or may be manually movable in response to rotation of a key assembly. In either case, extension of latch members 128, 130 functions to position the ends of latch members 128, 130 outwardly of the upper and lower edges, respectively, of the door, such as 59. The extended ends of latch members 128, 130 are received within slots 146, 156, to maintain the door in its closed position. Latch members 128, 130 are then movable to a retracted position in which the latch member ends are positioned inwardly of the top and bottom edges, respectively of the door, such as 59, to enable the door to be moved to its open position.

Figure 21:
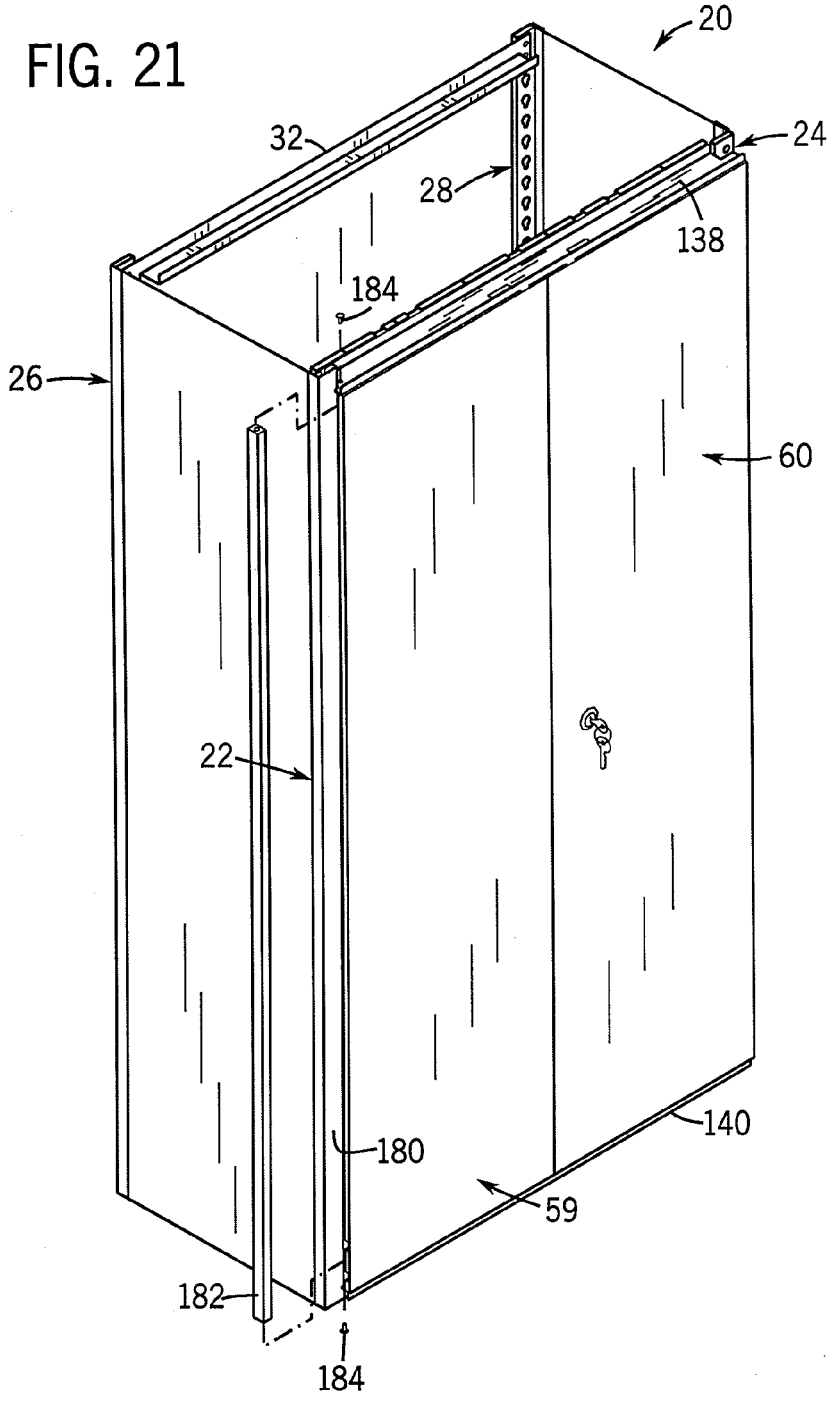
FIG. 21 is an isometric view of the assembled storage unit and door mounting arrangement of the present invention, in which the doors are mounted in an extended configuration.

FIG. 21 illustrates a door mounting arrangement in which extended mounting members, such as 68' (FIG. 13) are used to mount doors 59 and 60 to cabinet assembly 20. In this embodiment, horizontal walls 142 and 150 of latch/stop brackets 140 have an increased depth so as to accommodate the increased spacing of the door pivot axis from the front face of the cabinet assembly. This creates a gap 180 between the outer edge of the door and the adjacent post, such as 22. A gap filler post 182 is placed within gap 180, and is secured at its upper and lower ends to the latch/stop brackets, such as 138, 140, using screws 184 which extend into receivers provided in the ends of gap filler post 182.

It can thus be appreciated that the present invention provides a relatively simple arrangement for quickly and easily mounting doors to a conventional shelving or other storage unit. Door mounting assemblies 62 and 64 take advantage of the existing hole structure provided in the corner posts of the cabinet assembly, and are adapted for mounting to the corner posts without the need for tools. The use of the cabinet corner posts for mounting the doors provides accurate and reliable positioning of the doors relative to the cabinet assembly. The latch brackets are quickly and easily mounted to the existing shelf supports of the cabinet assembly using conventional screws and a driver, with a minimal number of steps and parts.

Various alternatives and embodiments are contemplated as being within the scope of the following claims particularly pointing out and distinctly claiming the subject matter regarded as the invention.

We claim:

1. A door mounting arrangement for a storage unit having an open area providing access to an interior defined by the storage unit, wherein the storage unit includes a structural member adjacent the open area and wherein the structural member includes a series of spaced openings, comprising:

a door;

a hinge having pivotable first and second sections, wherein the first section of the hinge is adapted for mounting to the door;

a mounting member to which the second section of the hinge is secured; and a releasable engagement arrangement interposed between the mounting member and the structural member of the storage unit, wherein the releasable engagement arrangement comprises a pair of spaced apart engagement members carried by the mounting member, wherein the engagement members are engageable within a pair of the spaced openings in the structural member and are configured to secure the mounting member to the structural member of the storage unit and thereby fixing the position of the second section of the hinge relative to the structural member of the storage unit.

2. The door mounting arrangement of claim 1, wherein the series of spaced openings are formed in an inner wall defined by the structural member and face toward the interior of the storage unit, wherein the mounting member includes an inner portion that carries the spaced apart engagement members, and an outer portion to which the second section of the hinge is mounted.

3. The door mounting arrangement of claim 2, wherein the pair of engagement members are engageable within the openings in the structural member via movement of the engagement members in an axial direction that is parallel to a longitudinal axis defined by the structural member.

4. The door mounting arrangement of claim 3, further comprising a releasable locking member interconnected with the inner portion of the mounting member, wherein the locking member is releasably engageable with the structural member upon movement of the mounting member in that axial direction for releasably maintaining the pair of engagement members within the pair of openings in the structural member.

5. The door mounting arrangement of claim 4, wherein the releasable locking member is selectively engaged within one of the openings in the structural member.

6. The door mounting arrangement of claim 5, wherein the releasable locking member is selectively engaged within an opening located between the pair of openings within which the pair of engagement members are engaged.

7. The door mounting arrangement of claim 5, wherein the releasable locking member is movably mounted to the inner portion of the mounting member, and wherein when the pair of engagement members are engaged within the pair of openings in the structural member, the locking member is movable between a locking position in which the locking member prevents movement of the mounting member relative to the structural member, and a release position in which the locking member allows disengagement of the pair of engagement members from the pair of openings to enable disengagement of the mounting member from the structural member.

8. The door mounting arrangement of claim 7, including a biasing arrangement for biasing the releasable locking member toward its locking position.

9. The door mounting arrangement of claim 8, wherein the biasing arrangement comprises a spring member interconnected with the locking member and secured to the inner portion of the mounting member, wherein the spring member is operable to bias the locking member toward its locking position.

10. The door mounting arrangement of claim 9, wherein the spring member is mounted to one of the engagement members, and wherein the locking member is secured to the spring member at a location spaced from the engagement member.

11. The door mounting arrangement of claim 2, wherein the inner portion of the mounting member comprises an inner wall and wherein the outer portion of the mounting member comprises an outer wall, wherein the inner and outer walls are substantially parallel.

12. The door mounting arrangement of claim 11, wherein the mounting member further includes an intermediate wall extending between and interconnecting the inner and outer walls.

13. The door mounting arrangement of claim 2, wherein the first and second sections of the hinge are releasably engageable with each other to enable the mounting member to be engaged with the structural member and the door to subsequently be mounted to the storage unit by engagement of the second section of the hinge with the first section of the hinge.

14. The door mounting arrangement of claim 1, wherein the door includes a movable latch arrangement at a location spaced from the hinge, and further comprising a retainer member engageable with the storage unit separately from the mounting member, wherein the latch arrangement is engageable with the retainer member for selectively maintaining the door in a closed position relative to the storage unit.

15. The door mounting arrangement of claim 14, wherein the storage unit includes upper and lower transverse members which extend between a pair of vertical structural members located one on either side of the open area of the storage unit, and wherein a retainer member is engageable with each of the upper and lower transverse members, wherein a latch member associated with the latch arrangement is engageable with each of the retainer members.

16. The door mounting arrangement of claim 15, wherein the latch arrangement includes upper and lower latch members movable to an extended position in which the upper and lower latch members project from upper and lower edges, respectively, defined by the door, wherein each retainer member includes an opening positioned so as to receive one of the latch members when the latch members are in the extended position.

17. A system for mounting a door to a storage unit, wherein the storage unit defines an interior and an open area providing access to the interior and adapted to be selectively closed by the door, and wherein the storage unit includes at least one vertical structural member that extends along a vertical axis and includes an inner wall having a series of spaced openings, comprising:

a hinge having pivotable first and second sections, wherein the first hinge section is adapted for mounting to the door; and a mounting bracket for securing the second section of the hinge to the vertical structural member of the storage unit, wherein the mounting bracket includes an inner portion having a pair of spaced engagement members engageable within a pair of the spaced openings in the vertical structural member by movement of the mounting bracket in a direction along the vertical axis, and an outer portion to which the second section of the hinge is mounted.

18. The system of claim 17, wherein the inner portion of the mounting bracket comprises an inner wall and the outer portion of the mounting bracket comprises an outer wall spaced from the inner wall, wherein the inner and outer walls are interconnected by an intermediate wall extending therebetween.

19. The system of claim 18, wherein the pair of spaced engagement members extend from the inner wall toward the outer wall.

20. The system of claim 19, further comprising a locking member mounted to the inner wall and adapted to engage an opening in the vertical structural member upon movement of the mounting bracket in a direction along the vertical axis for releasably securing the mounting bracket to the vertical structural member.

21. The system of claim 20, wherein the locking member is mounted to a spring member secured to the inner wall of the mounting bracket, wherein the spring member biases the locking member toward a locking position in which the locking member is received within one of the openings in the vertical structural member when the mounting bracket is mounted to the vertical structural member, and wherein the locking member is movable to a release position against the force of the spring member for enabling the mounting bracket to be disengaged from the vertical structural member.

22. The system of claim 18, wherein the first and second sections of the hinge are releasably engageable with each other, wherein the second section of the hinge is mounted to the mounting bracket for engagement with the vertical structural member along with the mounting bracket, and wherein the first section of the hinge is engageable with the second section of the hinge after mounting of the mounting bracket and second hinge section to the vertical structural member, for interconnecting the door with the storage unit.

23. A method of mounting a door to a storage unit having at least one vertical structural member located adjacent an open area of the storage unit adapted to be selectively closed by the door, wherein the vertical structural member extends along a vertical axis and includes an inner wall having a series of spaced openings, comprising the steps of:

providing a hinge having pivotable first and second sections;

mounting the first section of the hinge to the door;

mounting the second section of the hinge to a mounting member that carries at least a pair of spaced engagement members; and securing the mounting member to the vertical structural member by engaging the pair of engagement members within a pair of spaced openings in the inner wall of the vertical structural member and moving the mounting bracket in a direction along the vertical axis, wherein the engagement members are configured to secure the mounting member to the structural member of the storage unit and thereby fix the position of the second section of the hinge relative to the structural member of the storage unit.

24. The method of claim 23, wherein the step of mounting the second section of the hinge to the mounting member is carried out by securing the second section of the hinge to an outer wall defined by the mounting member, and wherein the mounting member includes an inner wall spaced from the outer wall and wherein the pair of spaced engagement members are carried by the inner wall.

25. The method of claim 23, further comprising the step of releasably locking the mounting member in position on the vertical structural member when the pair of spaced engagement members are engaged within the pair of spaced openings.

26. The method of claim 25, wherein the step of releasably locking the mounting member to the vertical structural member is carried out by providing a locking member on the mounting member and biasing the locking member toward a locking position wherein, when the pair of spaced engagement members are received within the pair of spaced openings, the locking member is received within an opening in the vertical structural member so as to prevent disengagement of the mounting member from the vertical structural member.

27. The method of claim 26, wherein the locking member is provided on a spring member secured to the mounting member, wherein the spring member functions to bias the locking member toward the locking position, wherein the spring member is movable against the biasing force of the spring member to move the locking member to a release position in which the locking member is disengaged from the opening in the vertical structural member to enable the mounting member to be moved relative to the vertical structural member so as to disengage the spaced engagement members from the pair of spaced openings in the vertical structural member.

28. The method of claim 23, wherein the storage unit includes at least one transverse structure member, and further comprising the step of mounting a retainer member to the transverse member separate from mounting of the door to the vertical structural member, wherein the retainer member is engageable with a latch mechanism associated with the door, wherein engagement of the latch mechanism with the retainer member functions to selectively retain the door in a closed position.

29. The method of claim 28, wherein the storage unit includes upper and lower transverse structural members, and wherein the step of mounting a retainer member to the transverse member comprises mounting an upper retainer member to the upper transverse member and mounting a lower retainer member to the lower transverse member.

30. The method of claim 29, wherein the upper and lower transverse members comprise shelf support brackets, and wherein each retainer member includes mounting structure for engaging the shelf support member and one or more threaded fasteners which extend through one or more openings in the retainer member and into engagement with the shelf support bracket for rigidly interconnecting the retainer member with the shelf support bracket.

31. The method of claim 23, wherein the storage unit includes a pair of spaced vertical structural members, each of which includes an inner wall having a series of spaced openings, and wherein a pair of doors are mounted one to each vertical structural member.

* * * * *